US007955668B2

(12) United States Patent
Fu et al.

(10) Patent No.: US 7,955,668 B2
(45) Date of Patent: Jun. 7, 2011

(54) MEDIA SHEET

(75) Inventors: Xulong Fu, San Diego, CA (US); Chang Shin Park, San Diego, CA (US); Ronald J. Selensky, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 473 days.

(21) Appl. No.: 11/546,809

(22) Filed: Oct. 12, 2006

(65) Prior Publication Data

US 2008/0090033 A1 Apr. 17, 2008

(51) Int. Cl.
*B41M 5/40* (2006.01)

(52) U.S. Cl. ..... 428/32.22; 428/32.26; 428/206; 428/220; 428/325; 428/341

(58) Field of Classification Search ..... 428/32.22, 428/3.26, 206, 220, 325, 341; 427/243
See application file for complete search history.

(56) References Cited

U.S. PATENT DOCUMENTS

| | | | | |
|---|---|---|---|---|
| 4,466,007 | A | 8/1984 | Nakamura et al. | |
| 5,352,503 | A | 10/1994 | Drake et al. | |
| 6,436,514 | B1 * | 8/2002 | Ishiyama et al. | 428/32.22 |
| 6,638,585 | B2 | 10/2003 | Niu et al. | |
| 6,824,842 | B2 | 11/2004 | Niu et al. | |
| 6,942,919 | B2 | 9/2005 | Tokiyoshi et al. | |
| 6,986,919 | B2 | 1/2006 | Hladik et al. | |
| 2002/0022116 | A1 * | 2/2002 | Iu et al. | 428/195 |
| 2002/0045034 | A1 | 4/2002 | Nakatani et al. | |
| 2002/0182380 | A1 * | 12/2002 | Nagashima et al. | 428/195 |
| 2003/0072925 | A1 * | 4/2003 | Kiyama et al. | 428/195 |
| 2005/0153227 | A1 | 7/2005 | Kurihara et al. | |
| 2006/0045997 | A1 | 3/2006 | Hladik et al. | |

FOREIGN PATENT DOCUMENTS

| | | | |
|---|---|---|---|
| EP | 0 605 840 | A | 7/1994 |
| FR | 2 691 989 | A | 12/1993 |
| JP | 2-234944 | A | 9/1990 |
| JP | 3-288686 | A | 12/1991 |
| JP | 4-224944 | A | 8/1992 |
| JP | 2000-45198 | A | 2/2000 |
| JP | 2003-293289 | A | 10/2003 |
| WO | WO-03/039864 | A1 | 5/2003 |
| WO | 2007/106885 | A | 9/2007 |

* cited by examiner

*Primary Examiner* — Betelhem Shewareged

(57) ABSTRACT

An embodiment of a media sheet has a barrier layer formed on a first surface of a substrate. An image-receiving layer is formed on the barrier layer. A porous pigment layer is formed on a second surface of the substrate.

24 Claims, 2 Drawing Sheets

MEDIA SHEET

BACKGROUND

Inkjet printing is a popular way of printing images on various media surfaces, particularly paper, for a number of reasons, including low printer noise, capability of high-speed printing, multi-color printing, relatively low cost to consumers, etc. With the demand for customized print matter, such as mailings, catalogs, brochures, and flyers increasing and digital cameras and other digital image-capturing devices becoming more prevalent, there is a demand for improved inkjet printing. For example, there is a desire for producing photographic-quality images, e.g., comparable to that of traditional silver halide photography, using inkjet printing.

After an image is printed on a media sheet, the printed media sheet is often sent an output tray. Frequently, two or more printed media sheets are successively sent to the tray and are stacked one upon the other, with a bottom surface of a subsequently printed media sheet overlying and in contact with the printed side of a previously printed media sheet. However, inkjet printing ink typically contains water or solvent that may not adequately dry, by evaporation, before the printed side containing the ink is covered by the back of a subsequently printed media sheet during stacking of the media sheets. This can cause color bleed, color shifting, and hazing (a reduction in the black optical density of a printed image), etc. in the stacked printed side.

DETAILED DESCRIPTION

In the following detailed description of the present embodiments, reference is made to the accompanying drawings that form a part hereof, and in which are shown by way of illustration specific embodiments that may be practiced. These embodiments are described in sufficient detail to enable those skilled in the art to practice disclosed subject matter, and it is to be understood that other embodiments may be utilized and that process, electrical or mechanical changes may be made without departing from the scope of the claimed subject matter. The following detailed description is, therefore, not to be taken in a limiting sense, and the scope of the claimed subject matter is defined only by the appended claims and equivalents thereof.

FIGS. 1A-1D are cross-sectional views of a portion of a media sheet during various stages of fabrication, according to an embodiment. The media sheet is suitable for use in inkjet imaging devices, such as color inkjet printers, thermal inkjet printers, piezoelectric inkjet printers, high-speed black-only inkjet printers, monochrome inkjet printers, etc.

Figure 1A:
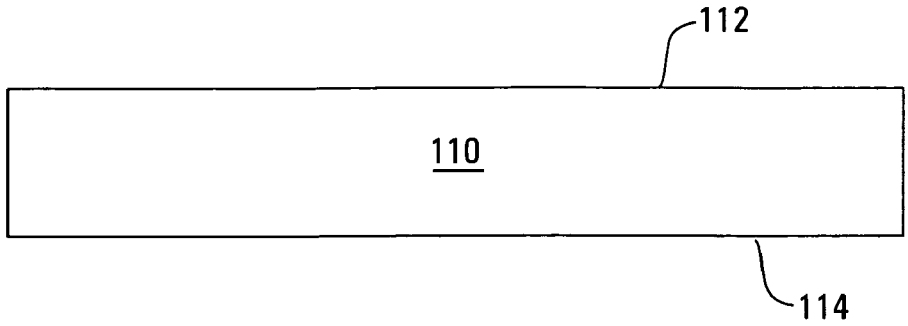
FIGS. 1A-1D are cross-sectional views of a portion of an embodiment of a media sheet during various stages of fabrication, according to an embodiment of the disclosure.

FIG. 1A illustrates a substrate (or base stock) 110. Substrate 110 has surfaces 112 and 114 that face in opposite directions. As described below, an image-receiving layer will be formed overlying surface 112, and a backing layer will be formed on surface 114.

Any number of traditionally used paper-fiber substrates may be used to form the substrate 110. For one embodiment substrate is any paper that includes fibers, fillers, additives, etc. Substrate 110 may be made from of any number of fiber types including, but in no way limited to, virgin hardwood fibers, virgin softwood fibers, recycled wood fibers, or the like. Fibers used to form substrate 110 may be less than approximately 3.0 mm in weighted average length. More specifically, for one embodiment, the fibers used to form substrate 110 have a weighted average length of about 0.5 mm to about 3.0 mm upon completion of a fiber refining process.

Substrate 110 may include a number of filler and additive materials. For one embodiment, the filler materials include, but are in no way limited to, clay, kaolin, calcium carbonate ($CaCO_3$), gypsum (hydrated calcium sulfate), titanium oxide, and/or cellulose fiber. For another embodiment, up to about 40%, by dry weight, of substrate 110 may be made up of fillers, including, but in no way limited to, calcium carbonate ($CaCO_3$), clay, kaolin, gypsum (hydrated calcium sulfate), titanium oxide ($TiO_2$), talc, Alumina trihydrate, magnesium oxide (MgO), minerals, and/or synthetic and natural fillers. Inclusion of these above-mentioned fillers may reduce the overall cost of substrate 110 for some embodiments. Including white filler, such as calcium carbonate, may enhance the brightness, whiteness, and the quality of substrate 110.

For one embodiment, substrate 110 may include sizing agents, e.g., metal salts of fatty acids and/or fatty acids, alkyl ketene dimer emulsification products and/or epoxidized higher fatty acid amides, alkenyl or alkylsuccinic acid anhydride emulsification products and rosin derivatives, dry strengthening agents, e.g., anionic, cationic or amphoteric polyacrylamides, polyvinyl alcohol, cationized starch and vegetable galactomannan, wet strengthening agents, e.g., polyaminepolyamide epichlorohydrin resin, fixers, e.g., water-soluble aluminum salts, aluminum chloride, and aluminum sulfate, pH adjustors, e.g., sodium hydroxide, sodium carbonate and sulfuric acid, optical brightening agents, and coloring agents, e.g., pigments, coloring dyes, and fluorescent brighteners.

For some embodiments, less than 20%, by dry weight, of substrate 110 may be fine content having a particle size of about 0.2 to about 5 microns, including chopped or fragmented small woody fiber pieces formed during the refining process of the pulp. According to other embodiments, the fine content may be about 4 to about 10 percent, by dry weight. A reduction in fine content facilitates the management of wet-end operation and retention. Additionally, substrate 110 may include any number of retention aids, drainage aids, wet strength additives, de-foamers, biocides, dyes, and/or other wet-end additives.

Figure 1B:
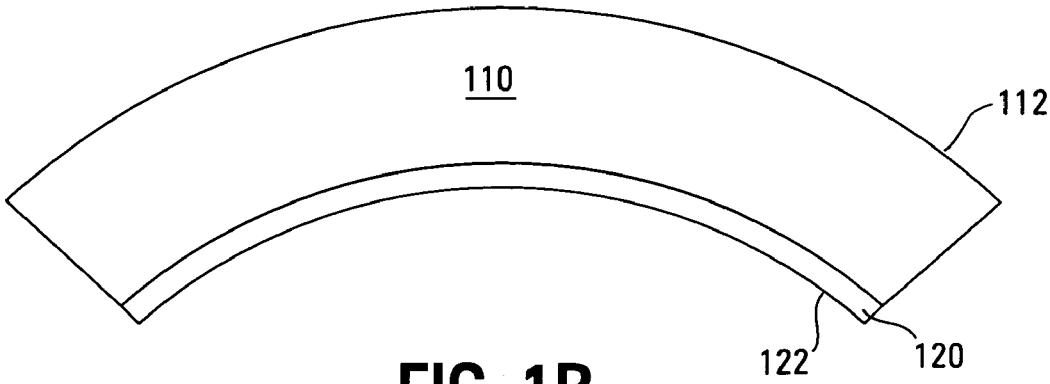

A backing layer, such as a pigment layer 120, is formed on surface 114 of substrate 110 in FIG. I B. For one embodiment, forming pigment layer 120 on surface 114 causes substrate 110 to curl so that surface 112 is convex, as shown in FIG. 1B, thereby producing a curled structure. In other words, forming pigment layer 120 on substrate 110 pre-stresses substrate 110, thereby producing a curvature in substrate 110 and thus in the structure of FIG. 1B.

For one embodiment, pigment layer (or pigment coating) 120 has a porous structure that can transfer vapor, such as a vaporized ink-vehicle, e.g., of water, of an inkjet ink. For another embodiment, the material of pigment layer 120 is hydrophobic and porous so that pigment layer 120 can transfer the vapor without substantially absorbing any moisture. For another embodiment, the material of pigment layer 120 is hydrophilic and porous.

For one embodiment, pigment layer 120 is formed by coating substrate 110 with a coating solution, e.g., an aqueous coating solution, that includes the materials of pigment layer 120 contained in a liquid, such as water. The coating solution may be applied using any suitable coating process, such as a wet coating process. Examples of suitable wet-coating processes include, but are not limited to, blade coating, rod coating, roll coating, size press, jet coating, air knife coating, bar coating, slot coating, slide coating or curtain coating, which are known in the art.

For one embodiment, the coating solution contains inorganic pigment, such as precipitated calcium carbonate, ground calcium carbonate, clay, kaolin clay, gypsum, etc., a water-soluble binder, e.g., synthetic or natural polymers, such as polyvinyl alcohol (PVOH), starch, protein, and, and other functional additives, such as cross-linker additives, plasticizers (e.g., dispersed polyethylene or polyprolane emulsion) or wax, defoamer, biocides, and surfactants. Examples of polyvinyl alcohol include, but are not limited to, Mowiol 6-98, Mowiol 20-98, Celvol 107, and Celvol 310. Examples of suitable cross-linker additives include, but are not limited to, glyoxal (BASF Aktiengesellschaft (DE)), ammonium zirconium, potassium zirconium carbonate, and glyoxal-based chemicals, such as Berset 2040 (Bercen, Inc., Cranston, R.I., U.S.A.) Sequarez 755 (OMNOVA Solutions Inc (Fairlawn, Ohio, U.S.A.)), etc. For another embodiment, the coating solution contains a non-water-soluble binder, such as latex, e.g., Styrene Butadiene Resin, Styrene Acrylic latex, etc. For another embodiment, the coating solution further includes about 20 to about 95 percent water, by weight. The coating solution can be prepared using a mixer, such as a Kady mixer, as known in the art. For one embodiment, the coating solution is pumped into a coater head and is applied to surface 114 of substrate 110.

After applying the coating solution to surface 114, the resulting coat is dried to a target moisture level, e.g., about 2 to about 10 percent by weight of the coat, using infrared heating or heated air or a can dryer or a combination thereof, for example. For one embodiment, however, the target moisture level is about 4 to about 6 percent by weight of the coat. For another embodiment, the dry coat weight is about 5 to about 60 grams/$m^2$. For another embodiment, the dry coat weight is about 15 to about 40 grams/$m^2$. For one embodiment, substrate 110 with pigment layer 120 formed thereon is passed between a pair of rollers, as part of a calendering process, after drying. For another embodiment, substrate 110 with the dried pigment layer 120 thereon, is calendered to a predetermined roughness and pre-stress, e.g., using an on-line calender or an off-line calender. For one embodiment, an outer surface 122 of pigment layer 120 has a "photo feel." Specifically, for one embodiment, the roughness of outer surface 122 is less than about 200 Sheffield units, e.g., about 10 to about 120 Sheffield units. For some embodiments, a substrate 110 or pigment layer 120 may be exposed to a steam shower before or after calendering to control pre-stress and/or pre-print or post-print curl.

For one embodiment, dried pigment layer 120 includes about 30 to about 90 percent, by weight, of the inorganic pigment, about 5 to about 70 percent, by weight, of the water-soluble binder, about 1 to about 20 percent, by weight of the water-soluble binder, of the cross-linker additive, and about 0.1 to about 10 percent of the plasticizer or wax. For some embodiments, the water-soluble binder acts to curl (or pre-stress) substrate 110. For other embodiments, the cross-linker additive acts to provide the hydrophobic property of pigment layer 120. For another embodiment, the plasticizer or wax acts to produce photo-feel at desired roughness target.

Figure 1C:
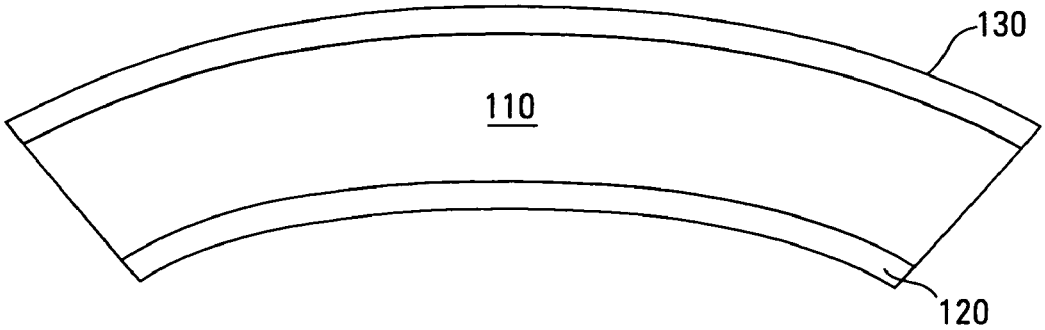

A barrier layer 130 is formed on surface 112 of substrate 110 in FIG. 1C. FIG. 1C shows that forming barrier layer 130 substrate 110 acts to reduce the curl (or curvature) of substrate 110 and thus the curl of the structure in FIG. 1B, resulting from forming pigment layer 120 on surface 114. For one embodiment, barrier layer 130 is formed using a hot-melt extrusion process. For another embodiment, barrier layer 130 is an extruded resin layer, such as an extruded polyolefin layer, e.g., an extruded polyethylene, polyvinylbutyral, or polypropylene layer. For one embodiment, an adhesion layer may be formed on barrier layer 130 to promote adhesion of a subsequently formed image-receiving layer. For another embodiment, barrier layer 130 is impervious to a ink-vehicle (or carrier) component of an inkjet ink, such as a liquid water ink-vehicle of the ink.

Figure 1D:
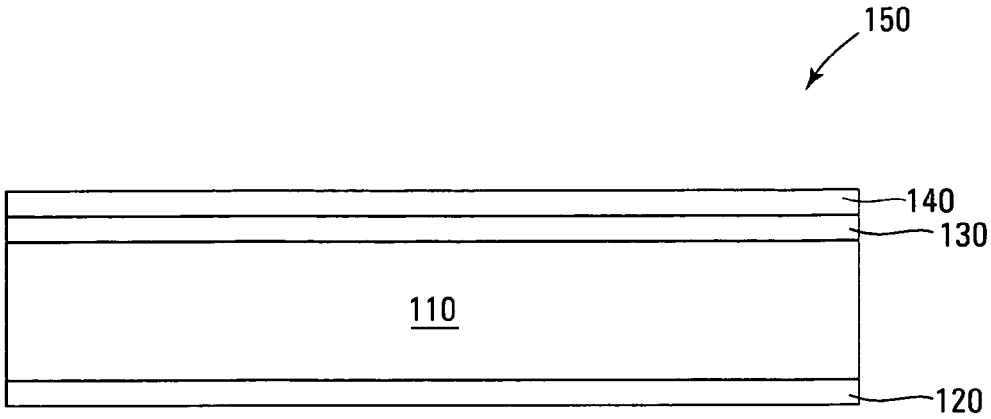

An image-receiving layer (or coating) 140 is formed on barrier layer 130 in FIG. 1D, e.g., using a coating process, thereby producing a media sheet 150. Note that forming image-receiving layer 140 on barrier layer 130 acts to substantially remove the curl (or curvature) of substrate 110, and thus the curl of the structure in FIG. 1C, so that substrate 110 and thus media sheet 150 are substantially straight or flat. Note further that without the pre-stress or curl caused by pigment layer 120 in FIG. 1B, media sheet 150 in FIG. 1D would be curled in a direction opposite that in FIG. 1 B and an outer surface of image-receiving layer 140 would be concave. A concave image-receiving layer 140, or a curl toward the image side, can cause various printing runnability issues, such as print head crash (or interference between the print head and a media sheet), improper sheet feeding, and other printing defects.

For one embodiment, image-receiving layer 140 is a porous layer and may include about 20 to about 40 grams/$m^2$ of a high-porosity, inorganic-oxide dispersion plus a binder and other additives, for example. For one embodiment, the high-porosity, inorganic-oxide dispersion may include any number of inorganic oxide groups including, but in no way limited to, a fumed silica or alumina, treated with silane coupling agents containing functional groups. The dry coat weight of the fumed silica or alumina treated with silane coupling agents containing functional groups that form image-receiving layer 140 may vary from about 20 to about 50 grams/$m^2$. For another embodiment, the dry coat weight of the fumed silica or alumina treated with silane coupling agents containing functional groups that form image-receiving layer 140 is about 25 to about 35 grams/$m^2$. For one embodiment, the fumed silica may be selected from the following group of commercially available fumed silica: Cab-O-Sil LM-150, Cab-O-Sil M-5, Cab-O-Sil MS-55, Cab-O-Sil MS-75D, Cab-O-Sil H-5, Cab-O-Sil HS-5, and Cab-O-Sil EH-5.

For one embodiment, barrier layer 130 may be coated with a fumed silica. The fumed silica may be treated with the aluminum chlorohydrate (ACH) or silane coupling agents, containing amino functional groups, and then coated on barrier layer 130. For this embodiment, the fumed silica may be any silica in colloidal form. Specifically, according to one embodiment, an aggregate size of the fumed silica may be about 50 to about 300 nanometers in size. For another embodiment, the fumed silica may be about 100 to about 250 nanometers in size. The Brunauer-Emmett-Teller (BET) surface area of the fumed silica may be about 100 to about 400 square meters per gram for one embodiment. For other embodiments, the fumed silica may have a BET surface area of about 150 to about 300 square meters per gram. Accordingly, a zeta potential, or electrokinetic measurement used to control the stability of a colloid, of the organic-treated silica at a pH of about 3.5 is at least about 20 mV.

Alternatively, in another embodiment, barrier layer 130 may be coated with an alumina that is similarly treated with the silane coupling agents containing functional groups. For one embodiment, the alumina coating has pseudo-boehmite, which is aluminum oxide/hydroxide ($Al_2O_3.n\ H_2O$ where n is from 1 to 1.5). Additionally, according to another embodiment, barrier layer 130 is coated with an alumina that comprises rare earth-modified boehmite, containing from about 0.04 to about 4.2 mole percent of at least one rare earth metal having an atomic number from 57 to 71 of the Periodic Table of Elements. According to this embodiment, the rare earth elements are selected from the group consisting of lanthanum, ytterbium, cerium, neodymium, praseodymium, and mixtures thereof. The presence of the rare earth changes the pseudo-boehmite structure to the boehmite structure. The presence of the rare earth element provides superior lightfastness, compared with an alumina basecoat not including the rare earth element.

As mentioned above, the layer of fumed silica or alumina can be treated with silane coupling agents containing functional groups, ACH, or combinations thereof. According to one embodiment, the silane coupling agents contain functional groups, such as primary amine, secondary amine, tertiary amine, quaternary amine, etc. According to another embodiment, the silane coupling agent with the amine functional group is used to convert the anionic silica to a cationic silica that is dispensed thereon.

As mentioned, image-receiving layer 140 may also include any number of surfactants, buffers, plasticizers, and other additives that are known in the art.

During application, image-receiving layer 140 can be coated onto barrier layer 130 by any number of material dispensing machines and/or methods including, but in no way limited to, a slot coater, a curtain coater, a cascade coater, a blade coater, a rod coater, a gravure coater, a Mylar rod coater, a wired coater, and the like.

After completing the formation of media sheet 150 in FIG. 1D, media sheet is typically cut into smaller media sheets, e.g., 8.5 by 11-inch media sheets, etc., as is known in the art.

The media sheets are typically disposed in a printer, such as an inkjet printer, e.g., in an in-tray of the printer. During an inkjet printing operation, inkjet ink is deposited on image-receiving layer 140, forming an image on image-receiving layer 140. Specifically, for one embodiment, image-receiving layer 140 absorbs an ink-vehicle (or carrier) component, e.g., of water, of the inkjet ink, leaving a solid colorant component of the ink, dissolved or suspended in the ink-vehicle prior to deposition, at or near the outer surface of image-receiving layer 140 in the form of an image. Barrier layer 130, for one embodiment, is impervious to the ink-vehicle and prevents the ink-vehicle from reaching substrate 110, and the ink-vehicle subsequently evaporates from image-receiving layer 140.

Figure 2:
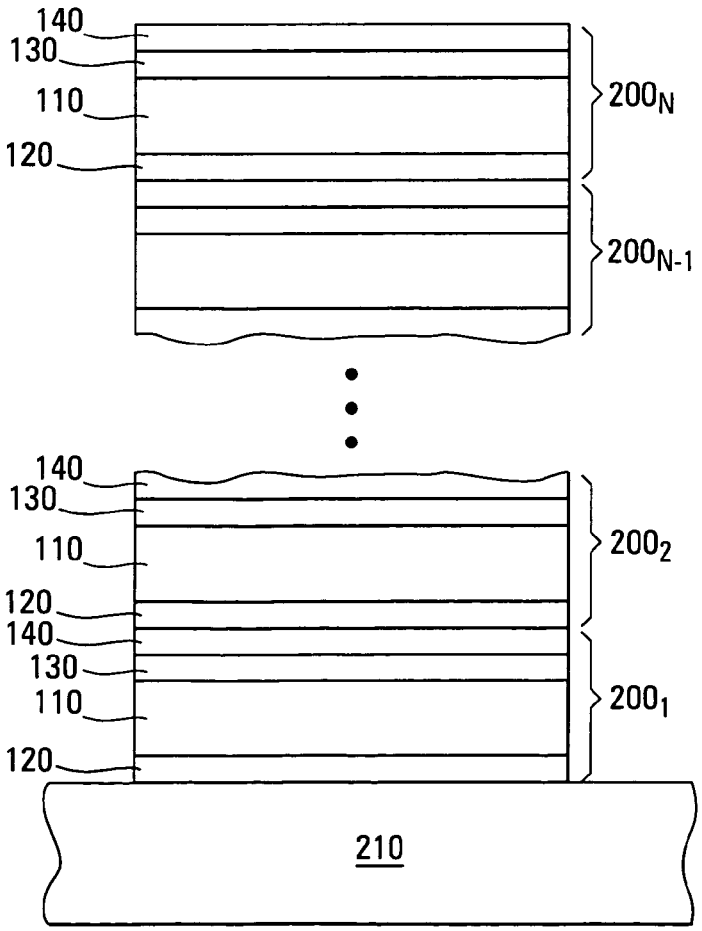
FIG. 2 illustrates a stack of media sheets, according to another embodiment of the disclosure.

For printing jobs involving a plurality of media sheets 200, the printed media sheets 200 are stacked one atop the other, e.g., in an out-tray 210 of the printer, as shown in FIG. 2, according to another embodiment. Specifically, a pigment layer 120 of a subsequently printed media sheet, e.g., printed media sheet $\mathbf{200}_2$, overlies an image-receiving layer 140 of a previously printed media sheet, e.g., printed media sheet $\mathbf{200}_1$, as shown in FIG. 2. For sufficiently high printing speeds and/or print densities, the subsequently printed media sheet may be stacked atop the previously printed media sheet before the ink-vehicle has sufficiently evaporated from the image-receiving layer of the previously printed media sheet.

The porous structure of a pigment layer 120 of a subsequently printed media sheet transfers ink-vehicle vapor of any ink-vehicle remaining after stacking from the image of the previously printed media sheet to the substrate 110 of subsequently printed media sheet. For example, pigment layer 120 of printed media sheet $\mathbf{200}_2$ transfers ink-vehicle vapor of any ink-vehicle remaining in and/or on the image receiving layer 140 of printed media sheet $\mathbf{200}_1$ after stacking from the image of printed media sheet $\mathbf{200}_1$ to the substrate 110 of printed media sheet $\mathbf{200}_2$. For one embodiment, the pigment layer 120 of a subsequent media sheet may absorb some liquid ink vehicle in addition to transporting the vaporous ink vehicle.

For some conventional media sheets, an ink-vehicle-absorbing backing layer is used in place of pigment layer 120 for absorbing liquid ink remaining in and/or on the image-receiving layer of a previous sheet. However, the image-receiving layer of the previous sheet may reabsorb the ink-vehicle from absorbing backing layer of the subsequent sheet, causing ink bleed in the image of the image-receiving layer. The hydrophobic, porous nature of pigment layer 120, for one embodiment, avoids this problem.

CONCLUSION

Although specific embodiments have been illustrated and described herein it is manifestly intended that the scope of the claimed subject matter be limited only by the following claims and equivalents thereof.

What is claimed is:

1. A media sheet, comprising:

a paper-fiber substrate having a first surface and a second surface opposite said first surface;

a porous pigment layer formed directly on the second surface of the substrate, said pigment layer imparting curl to said substrate and comprising an outer surface having a roughness less than 200 Sheffield units a barrier layer formed on the first surface of the substrate, said barrier layer counteracting said curl imparted by said porous pigment layer; and an image-receiving layer formed on the barrier layer, wherein, when used for printing an image, said media sheet avoids ink bleed in a printed image when a plurality of said media sheets are stacked after printing.

2. The media sheet of claim 1, wherein the pigment layer has a dry coat weight of about 5 to about 60 grams/$m^2$.

3. The media sheet of claim 2, wherein the pigment layer has a dry coat weight of about 15 to about 40 grams/$m^2$.

4. The media sheet of claim 1, wherein the pigment layer comprises inorganic pigment.

5. The media sheet of claim 1, wherein the pigment layer comprises a binder selected from the group consisting of a water-soluble binder, a non-water-soluble binder, and a latex binder.

6. The media sheet of claim 5, wherein said binder is a water-soluble binder and the pigment layer further comprises a cross-linker additive which provides a hydrophobic property to the pigment layer.

7. The media sheet of claim 1, wherein the pigment layer comprises a plasticizer or wax.

8. The media sheet of claim 1, wherein the pigment layer outer surface has a roughness of about 10 to about 120 Sheffield units.

9. The media sheet of claim 1, wherein the barrier layer is substantially impervious to an ink-vehicle of an ink.

10. A media sheet, comprising:

a paper-fiber substrate having a first surface and a second surface opposite the first surface;

a porous pigment layer comprising an outer surface having a roughness less than 200 Sheffield units, said pigment layer formed directly on said second surface and imparting curl to said substrate, the pigment layer comprising: about 30 to about 90 percent, by weight, of inorganic pigment;

about 5 to about 70 percent, by weight, of water-soluble binder; and about 1 to about 20 percent, by weight of the water-soluble binder, of a cross-linker additive which provides a hydrophobic property to the pigment layer, a barrier layer formed on the first surface of the substrate, said barrier layer counteracting said curl imparted by said porous pigment layer; and an image-receiving layer formed on the barrier layer, wherein, when used for printing an image, said media sheet avoids ink bleed in a printed image when a plurality of said media sheets are stacked after printing.

11. The media sheet of claim 10, wherein the inorganic pigment is selected from the group consisting of calcium carbonate, ground calcium carbonate, clay, kaolin clay, and gypsum.

12. The media sheet of claim 10, wherein the water-soluble binder is selected from the group consisting of polyvinyl alcohol, starch, and protein.

13. The media sheet of claim 10, wherein the pigment layer further comprises about 0.1 to about 10 percent of a plasticizer or wax.

14. A method of forming the media sheet of claim 1 comprising:

forming a porous pigment layer directly on the second surface of said paper-fiber substrate, wherein forming the pigment layer on the second surface of the substrate curls the substrate so that the resulting coated substrate is convex;

forming a barrier layer on the convex first surface, wherein forming the barrier layer on the convex first surface reduces the curl of the coated substrate; and forming an image-receiving layer on the barrier layer, wherein forming the image-receiving layer on the barrier layer substantially removes the curl from the coated substrate, causing the resulting media sheet to be substantially flat.

15. The method of claim 14, wherein forming the pigment layer on the second surface of the substrate comprises coating the second surface with an aqueous coating solution.

16. The method of claim 15, wherein the aqueous coating solution comprises about 20 to about 95 percent water, by weight.

17. The method of claim 14, wherein forming the barrier layer on the convex first surface comprises extruding the barrier layer on the convex first surface.

18. The method of claim 14, wherein forming the pigment layer on the second surface of the substrate comprises drying the pigment layer before forming the barrier layer.

19. The method of claim 14, wherein forming the pigment layer on the second surface of the substrate comprises calendering the pigment layer before forming the barrier layer.

20. The method of claim 14, wherein the pigment layer is hydrophobic or hydrophilic.

21. The method of claim 14, wherein forming the pigment layer on the second surface of the substrate comprises:

coating the second surface of the substrate with an aqueous coating solution;

drying the coated second surface; and calendering the substrate after drying the coated second surface.

22. The method of claim 21, wherein the aqueous coating solution comprises:

about 20 to about 95 percent water, by weight;

inorganic pigment;

a water-soluble binder;

cross-linker additives; and plasticizers or wax.

23. The method of claim 21, wherein forming the image-receiving layer on the barrier layer comprises coating the barrier layer.

24. A media sheet, comprising:

a paper-fiber substrate having a first surface and a second surface opposite said first surface;

a porous pigment layer formed directly on the second surface of the substrate, said pigment layer imparting curl to said substrate and comprising an outer surface having a roughness less than 200 Sheffield units;

a barrier layer formed on the first surface of the substrate, said barrier layer counteracting said curl imparted by said porous pigment layer such that said media sheet is without curl; and an image-receiving layer formed on the barrier layer, wherein, when the media sheet is used for printing and first and second media sheets are sequentially printed and stacked, the porous pigment layer of the second printed media sheet transfers inkjet ink vapor from the image-receiving layer of the first printed media sheet to the paper-fiber substrate of the second media sheet disposed atop the first media sheet.

* * * * *